US009371144B2

(12) United States Patent
Herrmann et al.

(10) Patent No.: US 9,371,144 B2
(45) Date of Patent: Jun. 21, 2016

(54) CONTAINER VOLUME CONTROL UNIT UPSTREAM OF FILLING LEVEL CONTROL UNIT

(75) Inventors: Jurgen Herrmann, Rosenheim (DE); Wolfgang Schom, Honningen (DE); Marius Michael Herrmann, Rosenheim (DE); Raik Rose, Dortmund (DE)

(73) Assignee: KHS GmbH, Dortmund (DE)

( * ) Notice: Subject to any disclaimer, the term of this patent is extended or adjusted under 35 U.S.C. 154(b) by 111 days.

(21) Appl. No.: 14/123,283

(22) PCT Filed: Mar. 23, 2012

(86) PCT No.: PCT/EP2012/001271

§ 371 (c)(1),
(2), (4) Date: Dec. 2, 2013

(87) PCT Pub. No.: WO2012/163442

PCT Pub. Date: Dec. 6, 2012

(65) Prior Publication Data

US 2014/0096863 A1 Apr. 10, 2014

(30) Foreign Application Priority Data

Jun. 1, 2011 (DE) ..... 10 2011 103 836

(51) Int. Cl.
*B65B 3/26* (2006.01)
*B67C 3/00* (2006.01)

(52) U.S. Cl.
CPC .. *B65B 3/26* (2013.01); *B67C 3/007* (2013.01)

(58) Field of Classification Search
CPC ..... B65B 3/26; B67C 3/007; B67C 3/284
USPC ..... 141/1, 94, 95, 192
See application file for complete search history.

(56) References Cited

U.S. PATENT DOCUMENTS

| | | | | |
|---|---|---|---|---|
| 5,505,312 | A * | 4/1996 | Haring et al. | 209/524 |
| 6,911,653 | B2 * | 6/2005 | Yagita | 250/341.1 |
| 7,337,595 | B2 * | 3/2008 | Harding | 53/504 |
| 7,342,655 | B2 * | 3/2008 | Yagita | 356/239.5 |
| 7,584,592 | B2 * | 9/2009 | Gabrielson et al. | 53/445 |
| 7,814,733 | B2 * | 10/2010 | Carlson et al. | 53/472 |
| 7,814,734 | B2 * | 10/2010 | Bilkie, Jr. | 53/473 |

(Continued)

FOREIGN PATENT DOCUMENTS

| | | |
|---|---|---|
| DE | 4332645 | 3/1995 |
| DE | 19602655 | 7/1997 |

(Continued)

*Primary Examiner* — Nicolas A Arnett
(74) *Attorney, Agent, or Firm* — Occhiuti & Rohlicek LLP

(57) ABSTRACT

A container-handling apparatus includes a filling machine for filling containers, a filling-level-monitoring control unit downstream of the filling machine, a first container-detection element configured to scan and relay at least a partial contour of a relevant container as inspection data, and a control-and-regulating device configured to receive inspection data about containers. The first container-detection element is separated from and upstream of the filling-level-monitoring control unit. The filling-level-monitoring control unit inspects a container and passes inspection data about the container to the control-and-regulating device. The first container-detection element inspects the container independently of the filling-level-monitoring control unit and passes inspection data about the container to the control-and-regulating device.

17 Claims, 3 Drawing Sheets

(56) References Cited

U.S. PATENT DOCUMENTS

| | | | | |
|---|---|---|---|---|
| 8,087,218 | B2 * | 1/2012 | Harding | 53/503 |
| 8,600,148 | B2 * | 12/2013 | Kwirandt | 382/142 |
| 2003/0201384 | A1 * | 10/2003 | Yagita | 250/223 B |
| 2005/0050848 | A1 * | 3/2005 | Harding | 53/58 |
| 2006/0244959 | A1 * | 11/2006 | Yagita | 356/239.6 |
| 2006/0283145 | A1 * | 12/2006 | Weisgerber et al. | 53/167 |
| 2007/0107801 | A1 | 5/2007 | Cochran et al. | |
| 2008/0092488 | A1 * | 4/2008 | Gabrielsen et al. | 53/428 |
| 2008/0115464 | A1 * | 5/2008 | Harding | 53/472 |
| 2008/0141625 | A1 * | 6/2008 | Bilkie | 53/396 |
| 2009/0178728 | A1 * | 7/2009 | Cochran et al. | 141/39 |
| 2010/0082149 | A1 * | 4/2010 | Till et al. | 700/214 |
| 2010/0158344 | A1 * | 6/2010 | Kwirandt | 382/142 |

FOREIGN PATENT DOCUMENTS

| | | |
|---|---|---|
| DE | 102004011101 | 3/2006 |
| DE | 102004038323 | 3/2006 |
| DE | 102005058616 | 6/2007 |
| DE | 102006047566 | 4/2008 |
| DE | 102006062536 | 7/2008 |
| DE | 102007041684 | 3/2009 |
| DE | 102008029208 | 12/2009 |
| DE | 102008030948 | 1/2010 |
| DE | 102008032370 | 1/2010 |
| DE | 102009009339 | 8/2010 |
| DE | 102009009340 | 8/2010 |
| DE | 102009016322 | 10/2010 |
| DE | 102009035605 | 2/2011 |
| DE | 102009040346 | 3/2011 |

* cited by examiner

CONTAINER VOLUME CONTROL UNIT UPSTREAM OF FILLING LEVEL CONTROL UNIT

RELATED APPLICATIONS

This application is the national stage entry under 35 USC 371 of PCT/EP2012/001271, filed on Mar. 23, 2012 which, under 35 USC 119, claims the benefit of the priority date of German application DE 10 2011 103 836.5, filed on Jun. 1, 2011 the contents of which are herein incorporated by reference.

FIELD OF DISCLOSURE

The invention relates to container-handling, and, in particular, to the monitoring of filling level in containers.

BACKGROUND

Containers can, for example, be used as bottles for liquids, for example, for drinks. The containers, e.g. bottles, can consist of a transparent or translucent material, for example glass or a translucent plastic, e.g. PET. However it is also conceivable that the containers could consist of other materials and that they can be filled with other filling materials.

Known container-handling devices are for example rinsers, fillers, labeling machines and so forth. Transport devices can be of the rotary or linear type, both these types exhibiting preferably circulating holding devices. A labeling machine, for example, exhibits an infeed star wheel, a transport star wheel on which different units can be disposed, and an outlet star wheel, which is in itself known and so will not be described in any more detail here.

On the container-handling devices, the respective containers are held on the holding devices along the transport direction. To this end, the containers, i.e. for example bottles, are held by their mouth region by way of the holding devices, with the containers, i.e. for example bottles, being able to stand on support devices such as, for example, turntables, or are transported suspended. The containers can, of course, also be held in their waist region.

DE 10 2004 011 101 A1 is concerned with a filling element for the contactless filling of containers with a liquid filling material. For the purpose of filling level monitoring, a probe can be moved to a measurement position in which the probe extends into the container.

DE 10 2004 038 323 B4, on the other hand, discloses a method for the bottom filling of bottles in which the filling tube is held only slightly below the level of the liquid, and in which a relative motion between filling tube and container is controlled.

DE 10 2005 058 616 A1 discloses a filling level monitoring in which a measuring probe is used.

DE 10 2007 041 684 A1 also concerns a filling device, in particular, one having a medium distribution device.

DE 10 2008 029 208 A1 relates to an open jet filling system, e.g. for the contactless filling of bottles. The system exhibits a fill-level probe disposed on a locating device. DE 10 2008 030 948 A1 again discloses a fill-level probe, with DE 10 2008 032 370 A1 also disclosing an electric probe for determining the filling level. DE 10 2009 009 339 A1 deals mainly with a filling system for the filling of containers, whereas DE 10 2009 009 340 A1 discloses a method for the pressure-filling of containers. DE 10 2009 016 322 A1 also discloses a filling system.

DE 10 2009 040 346 A1 discloses a container-handling device, in block design, comprising a combination of a stretch blowing device, a labeling device and a filling device.

DE 196 02 655 A1 discloses that a test bottle can be used for filling level control, with a displacement body being disposed inside the test bottle.

In DE 10 2009 035 605 A1 it is disclosed that during filling, the walls of the containers, such as, for example, the known PET bottles, can stretch because of the drink which is being filled. This stretching can vary from container to container because the extent of the stretching may depend on different factors such as, for example, different preform manufacturers, the age of the preform, variations in the stretch-blowing process, or the amount of time that elapses between the stretch-blowing process and the filling operation. This stretching occurs during the bottling of gas-carrying, such as for example carbonated, drinks and can also and in addition to the above factors vary as a function of the gas content. Depending on the extent of the stretching, the filling level also fluctuates for the same volumetric amount so that even a correct volumetric amount can bring about an incorrect filling level. Consequently DE 10 2009 035 605 A1 proposes measuring the filling volume so as to be able to determine, irrespective of the stretch condition, whether each of the filled containers exhibits the same filling level. Downstream of the volume measurement is a filling level control unit. But its only function is to determine whether the bottle has a leak. The volume measuring device as proposed by DE 10 2009 035 605 A1 is a flow meter.

It is known that containers can exhibit different contours, with it being possible to produce different filling height levels in the case of different contours, i.e. different outer shapes, despite the same filling volume. Generally however, liquid levels should not be arranged below the filling level control element as this suggests to the consumer an under-filled bottle even though the required volume is filled. Containers therefore exhibit certain tolerances such that even when the filling quantity is correct, the result of the filling level inspection fluctuates and the situation has to be averaged.

A certain compensation through observing the actual container contour is known from DE 10 2006 047 566 A1. This provides for an optical device that X-rays the transparent bottle and captures it with a camera, with the outer shape of the container being measured at the same time together with the filling level so as to be able to calculate the filling volume of the bottle in this way.

This approach, proposed by DE 10 2006 047 566 A1, has the disadvantage that the volume is determined as a function of the filled filling material in every case.

SUMMARY

The object of the invention is therefore a container-handling device and an inspection and filling method of the type referred to above, with which, independently of the volume filled in the container, a meaningful inspection result as to the filled volume is achievable based solely on the container contour, and/or a reliable statement can be made as to the volume that is to be filled.

A container-handling device is helpfully proposed that is executed, in particular, as a filling machine for filling containers, with filling level monitoring taking place downstream of the filling machine, and with the container-handling device having a container-detection element that, separated from the filling level monitoring, is disposed upstream of it, with both the filling level monitoring and the container-detection element passing respective inspection data of the container, which they inspect independently of one another, to a control-and-regulating device, with the at least one container-detection element detecting and passing on at least a partial contour of the container concerned as inspection data.

In this way the invention advantageously provides a container-handling device with which a container volume scanner, i.e. the container-detection element, is disposed upstream of filling level monitoring looking in the transport direction of the containers. The container volume scanner or container-detection element at least partially detects the true outer configuration of the container that is to be inspected, from which the container's internal volume can be directly inferred, and with the wall thickness also possibly being known. The container's internal volume can for example be determined in the control-and-regulating device. The data of the container volume scanner can be transferred by cable link or wirelessly to the control-and-regulating device for this purpose. An at least partial contour scan is obtained in the sense of the invention in that only an outer section of the container can be scanned if the container does not rotate past the container volume scanner with its entire circumference. Nevertheless the overall contour can be determined from the partial contour. It is of course possible to carry out an overall contour scan, with the container to be inspected rotating its entire circumference past one container-detection element or a plurality of container-detection elements each scanning a partial circumference contour, thus creating plural partial circumference contours that can then be combined to create an overall circumference contour. This can be carried out e.g. in the control-and-regulating device. The term "container-detection element" can, in the sense of the invention, refer to one individual element or to a plurality of elements, with partial circumference sections being combined to create a whole circumference.

The filling level control unit is provided downstream of the container volume scanner, i.e. also downstream of the actual container contour scanning. This unit too is connected wirelessly or by cable link to the control-and-regulating device for the purpose of data transfer. A data comparison between the internal container volume and the filling level can be carried out in this way. It is an advantage here that the two inspections, i.e. the actual contour scan of the container and the filling level control, are decoupled from one another.

It is essential that the container-detection element be arranged upstream of the filling level monitoring. In an initial embodiment, a container-detection element can be arranged downstream of the filling elements of the filling machine or even downstream of the filling machine but in any event upstream of the filling level monitoring. It is also possible for the container-detection element to be arranged upstream of filling elements or upstream of the filling machine. An arrangement in a feed to the filling machine is conceivable here.

A further preferred embodiment can be configured such that a first container-detection element is arranged upstream of the filling elements or upstream of the filling machine, with a second container-detection element being arranged downstream of the filling elements or downstream of the filling machine. This may be advantageous in the case of hot filling for example, in order to be able to scan and evaluate a stretch-related change in contour and hence a stretch-related change in the container's internal volume.

It may be expedient if the container contour is scanned upstream of the filling element(s) or of the filling machine so as to be able to generate a corresponding signal to the filling elements or to the filling valves by way of the detectable data. The volume that is to be filled can be dynamically matched to the particular container in this way. It is expedient in this regard if the control-and-regulating device is executed as a central control-and-regulating device of the container-handling device and in which relevant data can be combined, processed, evaluated, and stored, with corresponding decision signals being sent to the corresponding units. Decision signals may for example be a non-filling of the empty container, an overfilling above a nominal volume, a separating-out, a non-sealing (in a sealer) and/or a non-labeling (in a labeling machine), to name but a few examples.

It should be possible to fill the containers with a nominal volume quantity. It is, of course, advisable for this nominal volume quantity to be assigned limits, with a lower and an upper limit. If the container-detection element detects an actually fillable volume within the limits, then a signal for filling can be generated.

It is however also possible that a container is to be filled that, in regard to its container volume, can hold less than a lower threshold amount of a specified nominal volume quantity. If such a container is detected by the container-detection element, a corresponding signal to not fill or to subsequently separate out can be directly generated. Appropriate decision criteria are stored in the control-and-regulating device for this purpose to allow a comparison to be run quickly and easily. The same applies to a container with too great an internal volume and that could therefore be filled with a product quantity that exceeds the upper threshold amount. More product volume would have to be filled in this container than is permitted, or the product level indicates an apparent underfill. It is therefore possible for the faulty containers not to be filled so they can be separated out later. This however could result in a container gap that could adversely affect the capacity of the filling machine and/or downstream container handling machines. It can therefore be of advantage to nevertheless leave the containers in the production line so as to avoid the container gap. Product could also be filled in spite of the error message, whereby the filling volume could be increased for containers that are too big in terms of internal volume so as to maintain the maximum capacity. There can be an analogous arrangement for containers that are too small in terms of internal volume.

The filling level monitoring is therefore advantageously separate from the container volume scanner, which, with different types of filling level monitoring, nevertheless always leads to the same data in regard to the container's internal volume. A further decision criterion in the shape of the container's internal volume is also generated, and this can be used to advantage as a signal for the filling elements or filling valves and/or even for filling level monitoring. Because the container-detection element can be arranged upstream of the filling level monitoring and/or even upstream of the filling elements or of the filling valves, easy data handling can also be achieved because a very long process time is available.

The invention can, of course, be used on devices of a rotary or linear design. It is expedient that an advance recognition is facilitated that determines relevant data about the volume of the container concerned, it being possible to retrieve this information at any location within the transport line and to relay it to downstream inspection devices. The information can then be correspondingly correlated for example with the subsequent filling level monitoring of any type. For example, the volume measurement could be used to calculate the correction values of the filling level monitoring. If necessary, the information of the volume measurement can be retrieved by the possible downstream filling level monitoring for the correlation and correction of the current filling level measured value. For example, measured values of filling-level corrections can be used to determine specific values of volume and correlation indicative of a trend between the value of the filling level and the value of the volume. The filling level measured value can be determined in advance as a function of the determined volume.

As previously mentioned, filling level monitoring can be provided in all possible variants, e.g. by way of high frequency, and/or X-rays, and/or infrared methods, and/or simply with a camera and, if necessary, an associated processor unit. The volume measurement can also be performed in different appropriate ways, e.g. by way of HF, X-rays, IR, camera etc.

It is within the sense of the invention to determine the volume not only on the basis of the outer contour but also by determining the inner contour of the container, from which the volume may be directly inferred. Here again, different methods of determining the inner contour or volume are also possible. For example the inner contour, or the volume, could be detected or determined by way of a magnifier-effect lighting. It is, however, also possible to directly determine the inner contour by a simple image processing survey from the inside and the outside, which can be carried out, for example, by way of image processing aids such as lines, blob, contour, matching, colorimetry of the container and/or diameter.

Further advantageous embodiments of the invention are disclosed in the dependent claims and the following description of the Figures. In the Figures:

DETAILED DESCRIPTION

Figure 1:
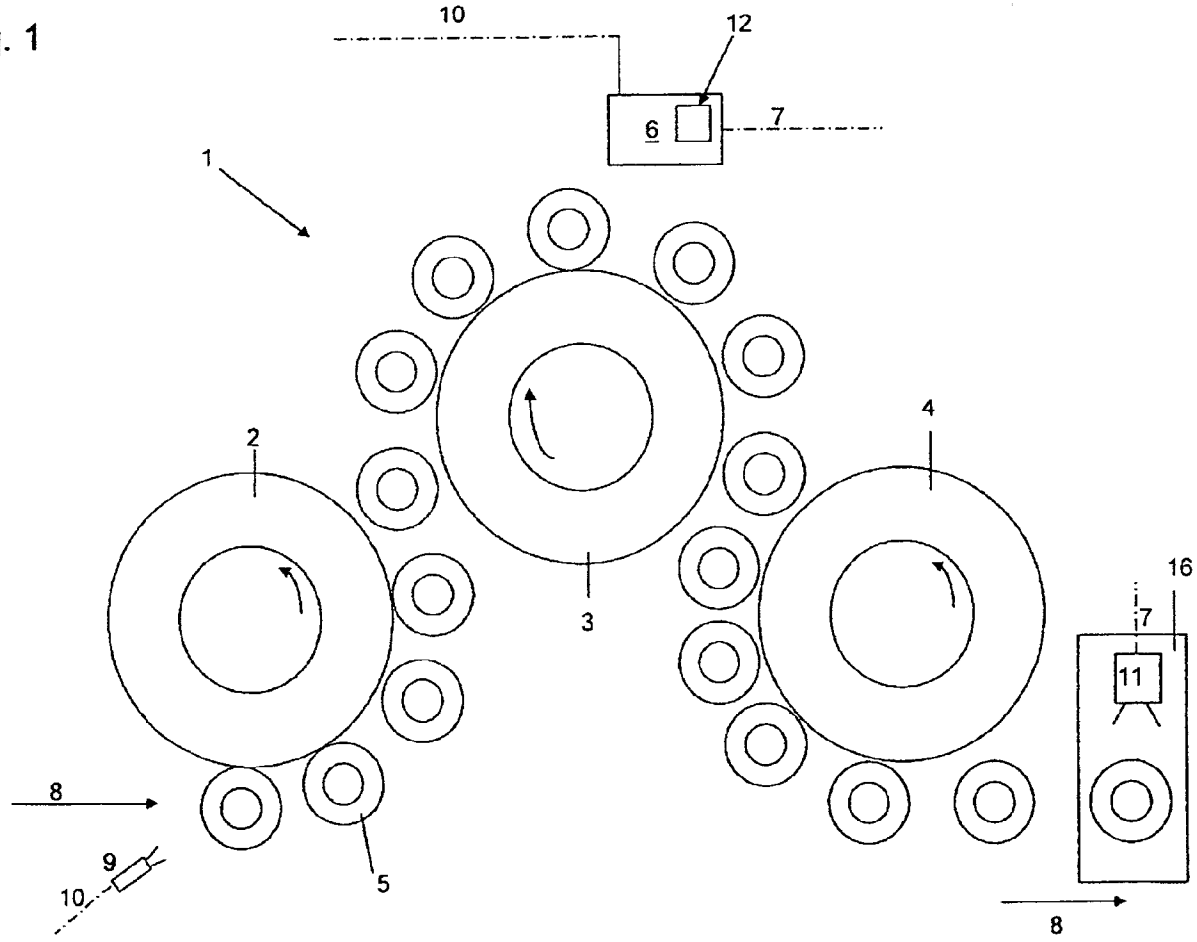
FIG. 1 shows a container-handling device in basic plan view.

FIG. 1 shows a container-handling device 1 in the embodiment as filling machine 1 of exemplary rotary type, whereby the invention should not be limited to rotary types but can of course also be provided for linear handling machines and/or along linear transport paths.

Filling machine 1 has an infeed star wheel 2, a main star wheel 3, and an outfeed star wheel 4. The proportions or dimensions of infeed star wheel 2 and of outfeed star wheel 4 relative to main star wheel 3 in FIG. 1 are of course not to scale. In reality, main star wheel 3 exhibits a greater diameter (e.g. 6 m) than infeed star wheel 2 and outfeed star wheel 4 (e.g. 1.5 m).

On main star wheel 3 are disposed filling elements that fill containers 5 with a product. Downstream of outfeed star wheel 4 is disposed a filling level monitor, of which only a camera 11 can be seen in FIG. 1, that is connected to a control-and-regulating device 6 as suggested by line 7. Control and regulating device 6 incorporates an image-processing device 12 that receives signals from camera 11. Arrows 8 indicate the transport direction. Image-processing device 12 of the one filling level monitoring control unit 16 may also be separated from control-and-regulating device 6 but still be in connection with it. Any other suitable signal transmitter/receiver and evaluator can of course also be used instead of a camera and image-processing device, in particular other sound emitters or radiation emitters and their respectively suitable receivers and evaluators.

Filling machine 1 advantageously exhibits at least one container-detection element 9 that is depicted in FIG. 1, by way of example, as camera 9. Container-detection element 9 scans at least a part of the circumference of container 5 and relays the resulting data to the control-and-regulating device 6, as shown by line 10, which for reasons of clarity is not extended as far as the at least one container-detection element 9. To this extent, container-detection element 9 scans an actual container contour independently of the filling level monitor or spatially separate from the at least one filling level monitoring control unit 16.

It is expedient that, when seen in transport direction 8, the at least one container-detection element 9 is arranged upstream of and separated from the filling level monitor or a filling level monitoring control unit 16, in particular of one of main star wheels 2, 3 or 4, it being particularly advantageous for container-detection element 9 to be disposed upstream of the filler.

The at least one container-detection element 9 can, for example, be provided at different locations. Thus a container-detection element 9 could be disposed at the infeed star wheel 2, and/or in a transfer region from infeed star wheel 2 to main star wheel 3, and/or in a transfer region from main star wheel 3 to outfeed star wheel 4, and/or at outfeed star wheel 4. The arrangement of container-detection elements 9 is generally only to be understood to be exemplary and is not limited to the named arrangement examples. It is essential that the at least one container-detection element 9 be arranged upstream of the filling level monitor. It is of course sufficient to provide only a single container-detection element 9. The arrangement locations are to be understood as being exemplary and in no way as limiting. The exemplarily stated plurality of container-detection elements 9 is only intended to highlight potential locations at which to arrange one or more container-detection elements.

It is also expedient that one container-detection element 9 be arranged upstream of the filling element or filling valve (not shown) and one downstream of the filling element or filling valve. Suitable locations include the transfer regions to and from main star wheel 3.

FIG. 1 shows container-detection element 9 with, by way of example, the symbol of a single camera. A single camera can, in fact, be positioned at the respectively suitable and proposed location in order to scan part of the circumference of container 5 and to transfer the recorded data onward. The single camera can however also record multiple images of container 5 if the latter rotates as it moves past container-detection element 9. The multiple images are then combined to form an overall contour. It is however also possible to provide multiple container-detection elements 9, i.e. multiple cameras, at the respectively suitable and proposed location, and this is to be encompassed by the invention even though only a single camera is shown for reasons of clarity. With multiple cameras, the overall contour of container 5 could be obtained by combining recorded partial contours. FIG. 1 shows container-detection element 9 as a camera by way of example only, it being possible for container-detection element 9 to be, in a preferred embodiment, a gate through which containers 5 can be guided along the transport direction in order for their actual contour to be scanned.

The outer contour of container 5 is advantageously determined with container-detection element 9 independently of the filled volume and independently of the result of the filling level monitor.

Figure 2:
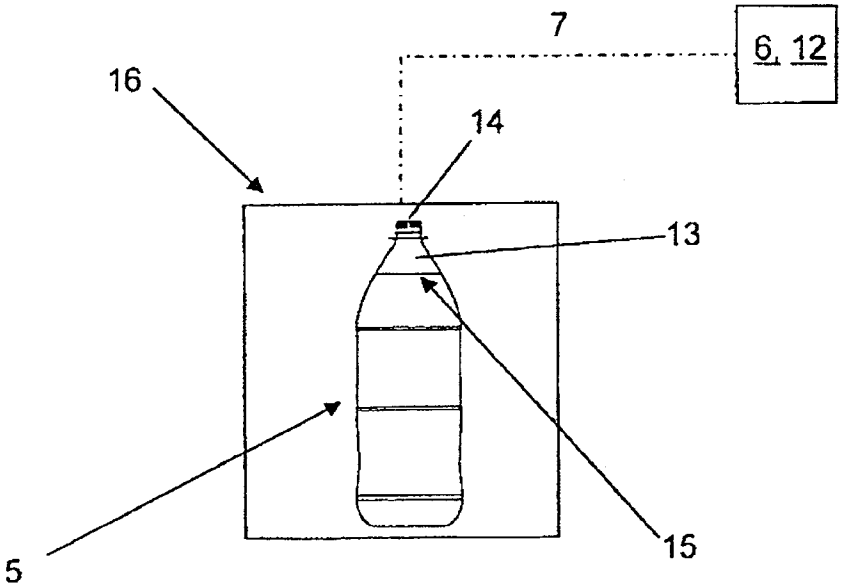
FIG. 2 shows an exemplary image recording as relayed to an image-processing unit and as used for filling level monitoring in a filling level monitoring control unit.
Figure 3:
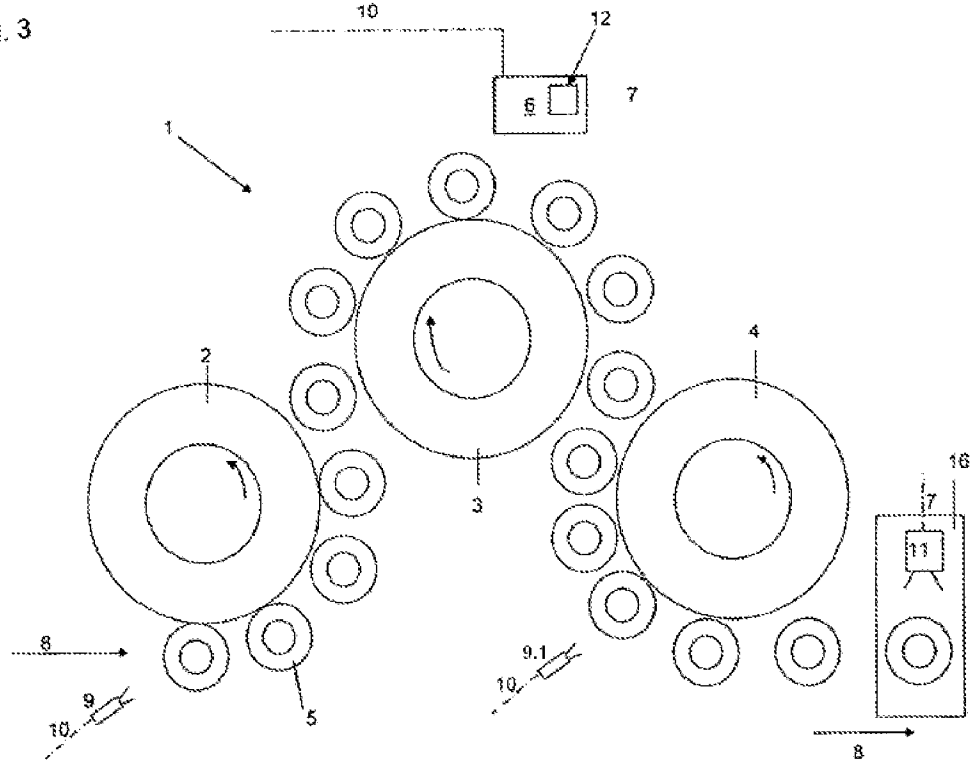
FIG. 3 shows an alternative embodiment having two container-detection elements.

For the monitoring of the filling level, filling level monitoring is provided in the transport direction of containers 5 for example with the at least one camera 11 that is aligned in such a way that it captures an image of containers 5, for example in the region of their bottle necks 13 and bottle mouths 14, as they are moved past with a transporter downstream of outfeed star wheel 4, as shown by way of example in FIG. 2, with bottle neck 13 being here depicted with a tapering form as an example only of course, whereby bottle mouth 14 can be surrounded by a cylindrically configured threaded section and/or a region receiving a seal. The at least one camera 11 is part of a monitoring system, i.e. of filling level monitoring, with an image-processing unit 12 that is integrated in control-and-regulating device 6 in which the images or image data supplied by camera 11 are evaluated in regard to the height of filling material surface 15. The images or image data supplied by camera 11 are processed by comparison with the nominal data stored in, for example, the image-processing unit. The image-processing unit can, for example, be a computer or computerized unit having corresponding inputs for analog or digital image data supplied by camera 11.

If filling material surface 15 is outside a range defined, for example, by one or a plurality of nominal criteria or nominal parameters as determined in the image-processing unit by reference to the stored nominal data, then, at a signal generated by the image-processing unit, containers 5 that are found to have a filling material surface 15 that does not match the nominal criteria are rejected at a discharge station with the aid of a device located there.

REFERENCE LIST

1 Container handling device/filling machine
2 Infeed star wheel
3 Main star wheel
4 Outfeed star wheel
5 Container
6 Control and regulating device
7 Connection of 6 to 11
8 Transport direction
9 Container detection element
10 Connection of 6 to 9
11 Camera
12 Image processing unit
13 Bottle neck
14 Bottle mouth
15 Filling material level
16 Filling level monitoring unit

The invention claimed is:

1. An apparatus for handling containers, said apparatus comprising a filling machine for filling containers, a filling-level-monitoring control unit downstream of said filling machine, a first container-detection element configured to scan and relay at least a partial contour of a relevant container as first inspection data, and a control-and-regulating device configured to receive inspection data about containers, wherein said first container-detection element is arranged to be separated from said filling-level-monitoring control unit, wherein said first container-detection element is arranged to be upstream of said filling-level-monitoring control unit, wherein said filling-level-monitoring control unit is configured to inspect a container and to pass second inspection data about said container to said control-and-regulating device, and wherein said first container-detection element is configured to inspect said container independently of said filling-level-monitoring control unit and to pass first inspection data about said container to said control-and-regulating device.

2. The apparatus of claim 1, wherein said first container-detection element is disposed downstream of said filling machine.

3. The apparatus of claim 1, wherein said filling machine comprises a main star wheel at which containers are filled, and wherein said first container-detection element is disposed downstream of said main star wheel.

4. The apparatus of claim 1, wherein said first container-detection element is disposed upstream of said filling machine.

5. The apparatus of claim 1, wherein said filling machine comprises a main star wheel at which containers are filled, and wherein said first container-detection element is disposed upstream of said main star wheel.

6. The apparatus of claim 1, further comprising a second container-detection element, wherein said first container-detection element is disposed upstream of said filling machine and said second container-detection element is disposed downstream of said filling machine.

7. The apparatus of claim 1, wherein said first container-detection element is disposed upstream of said filling machine, wherein said control-and-regulating device is further configured to receive second inspection data, wherein said second inspection data is indicative of a scanned contour of said container when said container is downstream of said filling machine.

8. A method for handling containers, said method comprising, at a first container-detection element that is separated from a filling-level-monitoring control unit that is downstream of a filling machine for filling containers and that is upstream of said filling-level-monitoring control unit, scanning and relaying at least a partial contour of said container as inspection data, at said filling-level-monitoring control unit, inspecting a container, thereby generating first inspection data, passing said first inspection data about said container from said filling-level-monitoring control unit to a control-and-regulating device, and at said first container-detection element, inspecting said container independently of said filling-level-monitoring control unit, thereby generating second inspection data, and passing second inspection data about said container from said first container-detecting element to said control-and-regulating device.

9. The method of claim 8, further comprising receiving, from said container-detection element, information indicating that said scanned container can receive no more than a lower threshold amount of a nominal volume quantity, and in response, at said control-and-regulating device, generating a signal for non-filling of said container.

10. The method of claim 8, further comprising receiving, from said container-detection element, information indicating that said scanned container can receive no less than an upper threshold amount of a nominal volume quantity, and in response, at said control-and-regulating device, generating a signal for non-filling of said container.

11. The method of claim 8, wherein scanning and relaying comprises scanning an outer contour of said container.

12. The method of claim 8, wherein scanning and relaying comprises scanning an inner contour of said container.

13. The method of claim 8, wherein scanning and relaying comprises scanning an outer contour of said container and scanning an inner contour of said container.

14. A method for inspection and filling on a filling machine for filling containers, said method comprising transmitting first inspection data to an instrumentation and control device, and transmitting said first inspection data is carried out independently of transmitting second inspection data to said an instrumentation and control device, said second inspection data comprising information resulting from a filling level check, wherein transmitting said first inspection data comprises, at a container detection element that is disposed upstream of said filling machine, detecting at least part of at least one of an inner contour and an outer contour of a container, and based on said detection, transmitting said first information, and wherein said first inspection data comprises information about said at least part of at least one of an inner contour and an outer contour of said container to an instrumentation and control device.

15. The method of claim 14, wherein said container detection element is separate from a filling level checking unit that carries out said filling level check, said method comprising placing said container detection element upstream of said filling level checking unit, and causing said filling level checking unit to transmit said second inspection data independently of transmission of said first inspection data.

16. The method of claim 14, further comprising, at said instrumentation and control device, maintaining a first value and a second value, wherein said first value is a lower limit of a set volume quantity and wherein said second value is an upper limit of a set volume quantity, and based on said first and second inspection data, generating a signal to cause a container to remain unfilled, wherein said container that remains unfilled is a container that can accommodate a volume that is no greater than said first value.

17. The method of claim 14, further comprising, at said instrumentation and control device, maintaining a first value and a second value, wherein said first value is a lower limit of a set volume quantity and wherein said second value is an upper limit of a set volume quantity, and based on said first and second inspection data, generating a signal to cause a container to remain unfilled, wherein said container that remains unfilled is a container that can accommodate a volume that is no less than said second value.

* * * * *